United States Patent [19]

Spugios

[11] 4,401,562

[45] Aug. 30, 1983

[54] CONVEYOR-SEPARATOR WITH ADJUSTABLE SEPARATION GAP

[75] Inventor: Aristos G. Spugios, Kalamazoo, Mich.

[73] Assignee: W-L Molding Company, Portage, Mich.

[21] Appl. No.: 244,518

[22] Filed: Mar. 16, 1981

[51] Int. Cl.[3] ..... B07C 5/04

[52] U.S. Cl. ..... 209/615; 209/693; 198/583

[58] Field of Search ..... 209/615, 616, 620, 625, 209/627, 659, 660, 665, 667, 668, 691, 692, 693; 198/575, 576, 583, 586, 592, 584

[56] References Cited

U.S. PATENT DOCUMENTS

| | | | |
|---|---|---|---|
| 214,415 | 4/1879 | Magone | 209/693 X |
| 895,529 | 8/1908 | Wyland | 198/583 |
| 2,209,268 | 7/1940 | Gouinlock et al. | 209/615 |
| 3,789,981 | 2/1974 | Rossio | 209/615 |
| 3,982,632 | 9/1976 | DeLeon et al. | 209/616 X |

FOREIGN PATENT DOCUMENTS

| | | | |
|---|---|---|---|
| 1571040 | 7/1980 | United Kingdom | 209/668 |

*Primary Examiner*—Bruce H. Stoner, Jr.
*Assistant Examiner*—Edward M. Wacyra
*Attorney, Agent, or Firm*—Flynn, Thiel, Boutell & Tanis

[57] ABSTRACT

A conveyor-separator apparatus having a separator unit slave driven from the conveyor unit by a gear train which employs an idler gear rotatably supported on the separator unit. The idler gear projects from the housing of the separator unit so as to be disposed in meshing engagement with a drive gear associated with the conveyor unit when the two units are joined together. This gear train also employs a drive gear which is in meshing engagement with the idler gear and is coaxially secured relative to the separator belt roller disposed adjacent the lower end of the separation gap. This driven gear is supported on an arm swingable about the axis of the idler gear, which arm can be selectively secured in a desired location. This swinging of the arm causes the axis of the drive gear, and hence the axis of the separator belt roller, to be selectively moved toward or away from the conveyor unit so as to selectively vary the width of the separation gap.

12 Claims, 7 Drawing Figures

CONVEYOR-SEPARATOR WITH ADJUSTABLE SEPARATION GAP

FIELD OF THE INVENTION

This invention relates to an improved apparatus for conveying and separating components, such as a mixture of molded plastic parts and runners, and more specifically to an improved drive arrangement associated with the fingered separator portion of the apparatus for permitting the separation gap to be selectively adjusted.

BACKGROUND OF THE INVENTION

The plastic molding industry has long been confronted with the problem of how to efficiently separate molded parts from runners as these components are discharged from a molding machine. This problem is particularly severe where large quantities of small parts are being simultaneously molded during each operation. To improve on this separation operation, there has been developed a "fingered" separator which employs a movable support or base, such as a belt, having a plurality of fingers projecting outwardly therefrom. The mixture of components is deposited on the fingered support such that the parts, being of smaller size, fall downwardly between the fingers for collection at a selected location. The runners, being of greater length, are caught by the fingers and are thus moved to a different location for collection. Such fingered separators are now well known and are rather extensively utilized in the plastic molding industry. One highly desirable type of fingered separator, wherein the fingered belt is supported on three rollers, is disclosed in U.S. Pat. No. 3,789,981 as owned by the assignee of this application.

To further improve upon the overall separating operation, fingered separators have been incorporated into a conveying and separating apparatus, which apparatus includes a conveyor (often a belt conveyor) for transporting the mixture of parts and runners to the fingered separator. This belt conveyor conventionally has the upper reach thereof inclined upwardly at a substantial angle, such that the mixture of components is deposited on the upper reach adjacent the lower end, with the mixture of components then being conveyed upwardly so as to be discharged onto the fingered separator. Because of the incline of the upper belt reach, coupled with the smallness and light weight of the parts, the belt is conventionally provided with upstanding transverse lugs to permit the components to be efficiently and effectively transported upwardly to the separator. Such conveyor, as illustrated by U.S. Pat. Nos. 4,171,044 and 4,050,575 both owned by the assignee of this application, are typically utilized in conjunction with a fingered belt separator positioned adjacent the upper conveyor belt roller so that there is a selected gap defined between the upper conveyor belt roller and an upwardly-moving inclined reach of the fingered separator belt. The conveyor thus deposits the mixture of components into this gap, whereupon the small molded parts fall downwardly between the fingers and are collected, whereas the runners are caught by the fingers and moved upwardly therewith and are hence transported by the fingered separator belt for discharge at a different location.

This known conveyor-separator apparatus has been proven to operate in a highly desirable and efficient manner for effecting separation of parts and runners at a relatively high rate of speed, and is able to achieve this separation with a high degree of efficiency. This known conveyor-separator apparatus has also proven highly desirable since, even though the conveyor and separator portions are formed as separable units which are joined together, nevertheless the separator unit is slave driven from the conveyor unit so that only a single drive motor is required, in contrast to other known conveyor-separator apparatus which have required separate drive motors for both units. In addition, the use of a three-roller support for the fingered separator belt is also believed to provide more efficient separation of the parts and runners than is achieved by other competitive apparatus which utilize only a two-roller support for the fingered separator belt.

Thus, while the assignee's conveyor-separator apparatus has performed in a highly desirable manner and hence has achieved substantial commercial acceptance, it still possesses structural and operational limitations which are less than optimum, particularly since the separation gap is of a fixed width, and changing the width of this gap has previously been possible only by rather extensive reconstruction of the apparatus, such as by positioning spacers between the adjoining ends of the conveyor and separator units, and by additionally removing and replacing the drive gears which join between the conveyor and separator units so as to compensate for the additional spacers. Needless to say, such a modification is time-consuming and requires substantial disassembly and reassembly of both units, which not only requires substantial service time but also results in the apparatus being shut down and hence nonproductive for a substantial period of time.

Since many industries are now molding substantially larger parts and hence larger runners, the separation gap required for effectively separating these larger parts and runners is substantially greater than the separation gap required for separating small molded parts, and this large separation gap can not be successfully utilized with small parts. Hence, the present invention effectively overcomes this disadvantage by enabling the separation gap to be easily and selectively adjusted over a substantial range so that the apparatus can be efficiently and successfully utilized for separating molded mixtures of components which may be of either small or large size. This adjustment can be accomplished without requiring any reconstruction or disassembly of the apparatus, and in fact can be accomplished in a simple and efficient manner requiring very little time or effort. At the same time, this desirable apparatus still permits the separating unit to be slave driven from the conveying unit, but does not require any replacement of the drive train used for drivingly connecting the two units together.

In the improved conveyor-separator apparatus of this invention, the separator unit is slave driven from the conveyor unit by a gear train which employs an idler gear rotatably supported on the separator unit, which idler gear projects from the housing of the separator unit so as to be disposed in meshing engagement with a suitable gear associated with the conveyor unit when the two units are joined together. This gear train also employs a drive gear which is in meshing engagement with the idler gear and is coaxially secured relative to the separator belt roller disposed adjacent the lower end of the gap. This driven gear is supported on an arm which is swingable about the axis of the idler gear, which arm can be selectively secured in a desired location. This swinging of the arm causes the axis of the drive gear, and hence the axis of the aforesaid separator belt roller, to be selectively moved toward or away from the conveyor unit so as to selectively vary the width of the separation gap.

Other objects and purposes of the invention will be apparent to persons familiar with apparatus of this general type upon reading the following specification and inspecting the accompanying drawings.

Figures 1, 2:
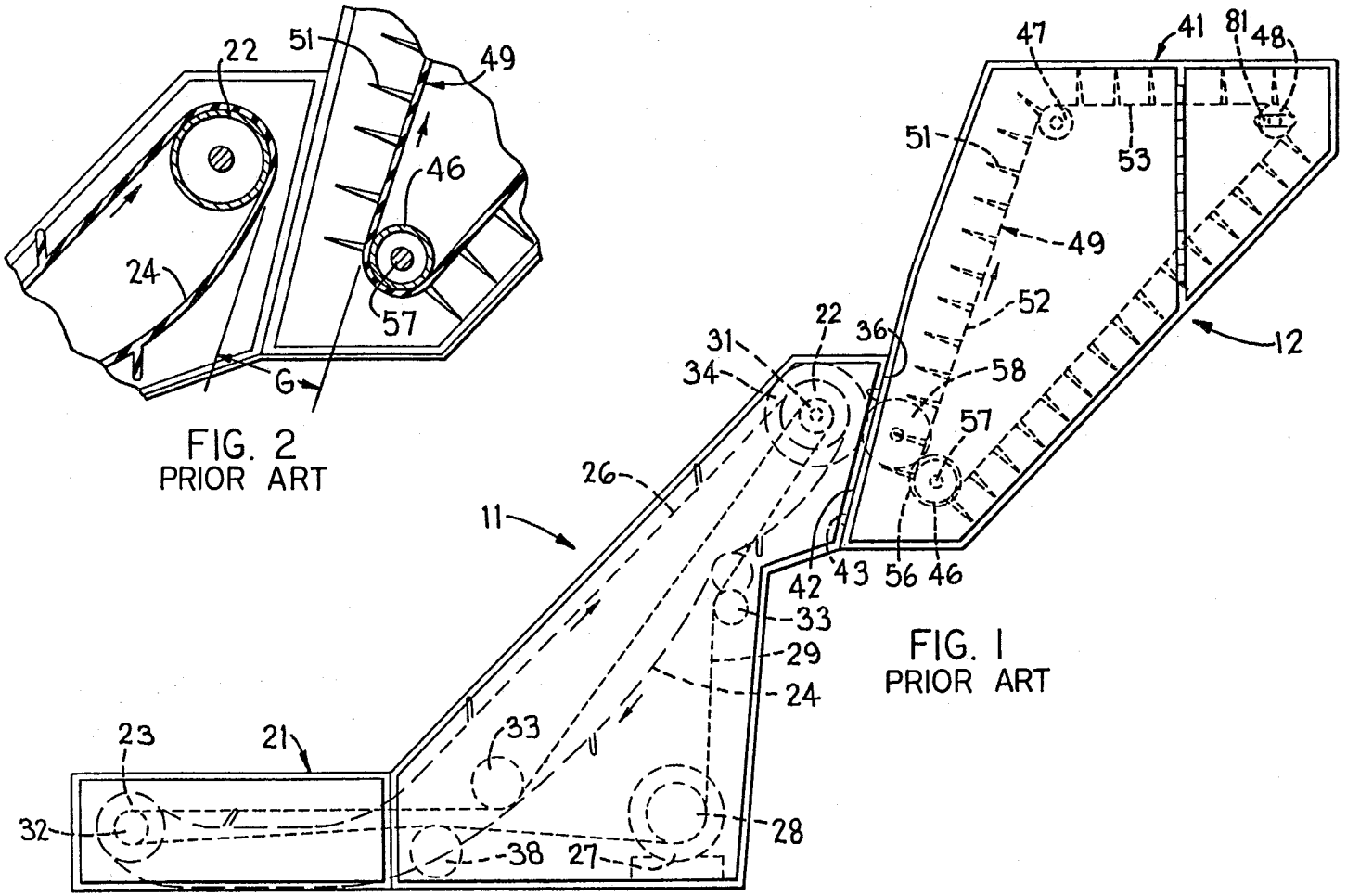
FIG. 1 PRIOR ART
FIG. 2 PRIOR ART
FIG. 1 is a side elevational view illustrating a conveyor-separator apparatus known in the prior art.
FIG. 2 is an enlarged, fragmentary sectional view illustrating the fixed separation gap associated with the prior art apparatus of FIG. 1.
Figure 3:
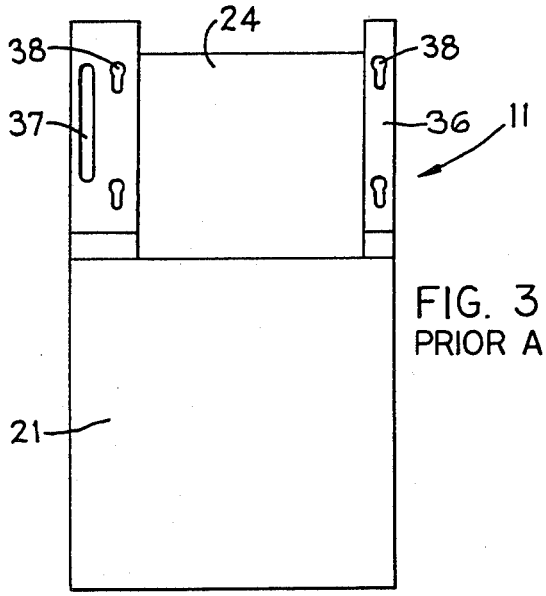
FIG. 3 PRIOR ART
FIG. 3 illustrates an end elevational view of the known conveyor unit, as taken from the right side thereof as appearing in FIG. 1.
Figure 4:
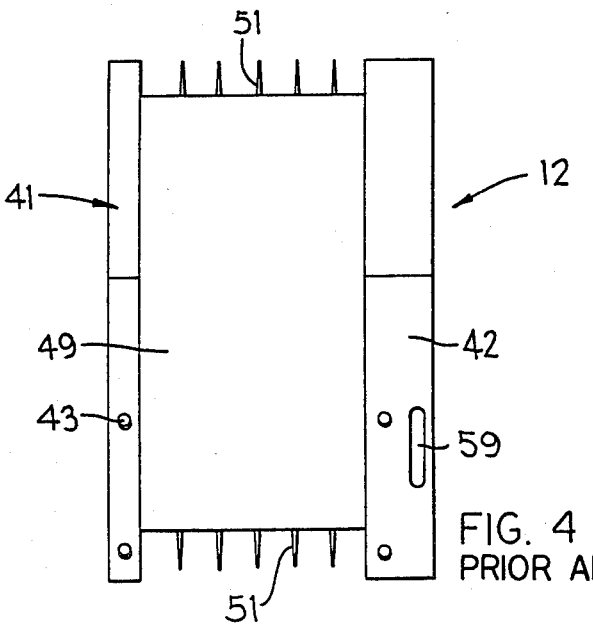
FIG. 4 PRIOR ART
FIG. 4 is an end elevational view of the known separator unit, as taken from the left side thereof as appearing in FIG. 1.

Certain terminology will be used in the following description for convenience in reference only, and will not be limiting. For example, the words "upwardly," "downwardly," "rightwardly" and "leftwardly" will refer to directions in the drawings to which reference is made. The word "forward" will refer to the normal direction of movement of the parts through the apparatus, which movement is from left to right in FIG. 1. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

FIGS. 1–4 illustrate therein a known conveyor-separator apparatus 10 as developed and commercialized by the assignee of this application. This apparatus includes a belt-type conveyor unit or section 11 for supplying a mixture of molded plastic components to a fingered separator unit or section 12 for permitting effective separation of the molded parts from the runners. These units 11 and 12 are preferably separable from one another, and are individually described hereinafter.

Considering first the conveyor unit 11, same includes a housing 21 which rotatably supports thereon upper and lower belt rollers 22 and 23, respectively. An endless flat conveyor belt 24 extends between and is supported on the rollers 22 and 23, which belt conventionally is provided with elongated rodlike cleats or lugs fixed to and projecting outwardly therefrom at selected intervals therealong. The upper roller 22 is spaced upwardly from and sidewardly displaced relative to the lower roller 23 so that the upper reach of the belt 24 thus includes an upwardly-inclined portion 26 so that the mixture of components can be deposited on the upper belt reach in the vicinity of the lower roller 23, and then carried upwardly by the inclined belt portion 26 for discharge adjacent the upper belt roller 22.

The conveyor belt 24 is driven from a suitable motor 27 which is positioned interiorly of the conveyor housing and has a rotatable drive sprocket 28 associated therewith, the latter being in driving engagement with an endless driving element such as a chain 29. This chain in turn is suitably drivingly engaged with several idler sprockets 33 and is also in driving engagement with driven sprockets 31 and 32 which are coaxially fixed to the belt pulleys 22 and 23, respectively, for rotatably driving same.

The conveyor housing 21 has an approximately vertically oriented front end wall 36 positioned adjacent the upper conveyor roll 22. This end wall 36 has a vertically elongated slot 37 formed adjacent one side thereof, and also has several keyhole-shaped slots 38 therein, all for a purpose to be explained hereinafter. This slot 37 is positioned closely adjacent to and substantially aligned with a drive gear 34 which is positioned within the conveyor housing and, in the illustrated embodiment, is coaxially aligned and fixed to the drive sprocket 31 and upper belt pulley 22 for synchronous rotation therewith. This gear 34 is provided for effecting driving of the hereinafter described separator unit 12.

The conveyor unit 11 is illustrated and described in aforementioned U.S. Pat. No. 4,171,044, so that further description and illustration of same is believed unnecessary.

Regarding the known separator unit 12, same includes a housing 41 having a rear end wall 42 which is also approximately vertically oriented and has a plurality of headed pins 43 fixed thereto and projecting outwardly therefrom. This rear wall 42 is adapted to be disposed in abutting engagement with the front wall 36 of the conveyor housing 21, with these two housings being fixedly secured together due to the headed pins 43 being engaged within the keyhole-shaped slots 38.

The housing 41 of the separator unit 12 rotatably supports thereon three belt rollers, namely the rollers 46, 47 and 48, which rollers are rotatable about parallel horizontally extending axes which are also parallel with the axes of conveyor rollers 22 and 23. An endless fingered separator belt 49 is supported on and extends around the rollers 46–48 so that the belt assumes a substantially triangular shape. The separator belt 49 has a plurality of elongated fingers 51 secured thereto and projecting outwardly therefrom in approximate perpendicular relationship. These fingers 51 are disposed at substantially uniform spaced intervals within rows which extend perpendicularly across the width of the belt, with said rows also being spaced at substantially uniform intervals throughout the complete length of the belt.

The belt rollers 46–48 are spacially positioned so that the upper rear belt roller 47 is positioned upwardly a substantial distance above the lower belt roller 46 and is also spaced slightly forwardly relative thereto, whereupon an upwardly-extending reach 52 of the fingered belt thus extends between these belt rollers 46 and 47. This belt reach 52, normally referred to as the separating reach, moves upwardly from the lower roller 46 toward the upper roller 47, and extends in a vertical direction but at a slight forward incline. The other belt roller 48, namely the upper front belt roller, is spaced horizontally forwardly a substantial distance from the belt roller 47, but at substantially the same elevation, so as to define therebetween a substantially horizontal top belt reach 53 which moves toward and around the front roller 48, which reverse curvature of the belt as it passes around the front roller 48 thus defines the discharge region for the runners which are engaged with the fingered belt.

As illustrated by FIG. 2, the inclined belt reach 52 is positioned closely adjacent but spaced from the discharge end of the conveyor belt 24, which discharge end is defined by the wrap-around of the conveyor belt on the upper belt pulley 22, thereby defining a preselected distance G between the conveyor and separator belts, which distance G is referred to as the separation gap. When the mixture of components passes around the conveyor pulley 22 and is deposited into the gap G, the small plastic parts pass vertically downwardly through the gap G due to the ability of the parts to pass between the fingers 51. The runners, on the other hand, are of a size such that they are unable to pass through the gap G, and hence become engaged with the fingers 51 and are thus carried upwardly along the reach 52 onto the horizontal reach 53, whereupon the runners are discharged from the fingers when the belt passes around the front roller 48.

The separator unit 12 is preferably slave driven from the conveyor unit 11 so as to permit the complete apparatus to be operated from a single drive source or motor. This is achieved in the known separator unit 12 by providing the latter with a driving gear 56 which is coaxially fixed to the lower belt pulley 46, which pulley 46 and driving gear 56 are both nonrotatably connected to a common shaft 57, which shaft in turn is rotatably supported on the housing by suitable bearing blocks which define a horizontally-extending rotational axis. This driving gear 56 is in turn disposed in direct meshing engagement with an idler gear 58 which is also rotatably supported on the housing 41 about a fixed axis. This idler gear 58 is disposed closely adjacent the rear housing wall 42, and in fact a portion of this idler gear 58 projects through an elongated slot 59 formed in the rear housing wall 42 so that the idler gear 58 can hence project through the slot 37 formed in the conveyor housing, whereby the idler gear 58 will thus automatically meshingly engage with the drive gear 34 when the separator unit is attached to the conveyor unit. The separator unit 12 is hence slave driven from the conveyor unit 11.

The conveyor-separator apparatus 10 illustrated by FIGS. 1–4, as briefly described above, is well known and the operation of same is believed well understood in view of the operational description set forth above.

Figure 5:
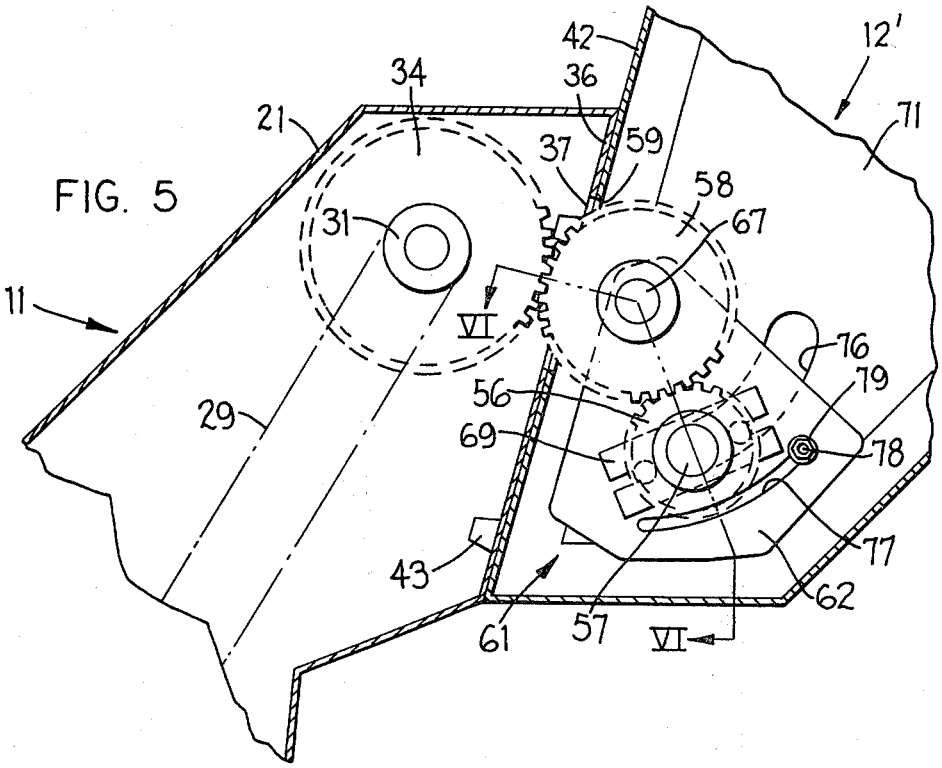
FIG. 5 is an enlarged, fragmentary sectional view illustrating the region where the conveyor and separator units are joined together, and specifically the slave drive connection therebetween, in accordance with the improved apparatus of this invention.
Figure 6:
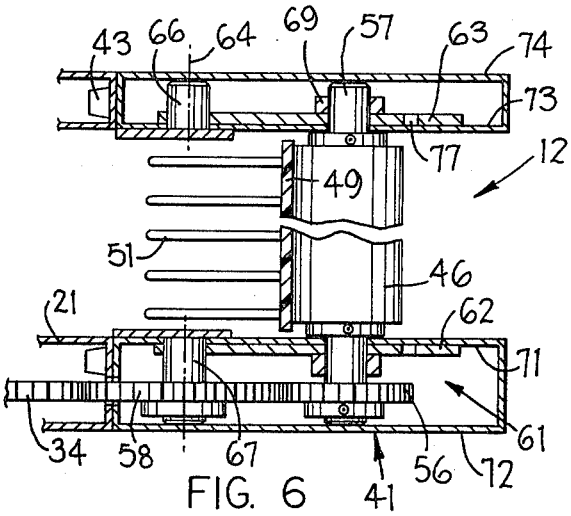
FIG. 6 is a fragmentary sectional view taken substantially along line VI—VI in FIG. 5.

To enable the separation gap G between the conveyor and separator units to be selectively adjusted, the present invention hence relates to an improvement associated with the separator unit, which improved separator unit is designated 12' in FIGS. 5 and 6 so as to distinguish same from the known separator unit 12 of FIG. 1. However, since the improved separator unit 12' is of the same overall construction and operation as the unit 12, and in fact utilizes most of the same components, the improved unit 12' thus utilizes the same reference numerals for designating the corresponding components.

Referring to FIGS. 5 and 6, the improved separator unit 12' incorporates an adjusting structure 61 for permitting the width of the separation gap to be adjusted. This adjusting structure 61 includes a pair of swingable support plates or arms 62–63 which are disposed adjacent the opposite sides of the separator housing and are swingable about a horizontal axis 64, which axis is defined by a pair of aligned stub shafts 66–67 which individually swingably support the respective arms 62–63. The stub shaft 67 also rotatably supports thereon the idler gear 58.

The lower belt pulley 46 is positioned between the arms 62–63 and its shaft 57 is rotatably supported thereon by bearing blocks 69 which are fixed to the arms.

The swingable arm 62 is disposed within a housing compartment located adjacent one side of the separator unit, which housing compartment is defined between inner and outer sidewalls 71 and 72, respectively. The other swingable arm 63 is similarly disposed within a housing compartment adjacent the other side of the unit, which housing compartment is also defined between inner and outer sidewalls 73 and 74, respectively. The lower belt roller 46 extends across a majority of the width between the opposed inner sidewalls 71 and 73, which sidewalls effectively define therebetween a channel for confining the fingered separator belt.

The opposed inner sidewalls 71 and 73 have aligned elongated slots 76 formed therein, which slots are sized to accommodate the shaft 57. These slots 76 are of an arcuate elongate configuration, with the elongate centerline of each slot 76 being generated about the axis 64 as a center. Hence, the plates 62–63, and the shaft 57 and belt roller 46 mounted thereon, can be swingably displaced about axis 64 through a limited arcuate extent as determined by the length of slots 76. These slots 76 preferably extend through an angle of at least approximately 60°, and the uppermost extent of slot 76 is positioned so as to enable the roller shaft 57 to be moved upwardly so that its axis is disposed substantially within a plane which passes through the axis 64 and through the axis of the drive gear 34.

The driver gear 56 for the lower belt roller 46 is secured to the shaft 57, as previously described, and this drive gear 56 is disposed in meshing engagement with the idler gear 58, the combined radii of the gears 56 and 58 hence being equal to the radial spacing between axis 64 and the axis of the shaft 57. Thus, when the arms 62–63 and the belt roller 46 are swingably displaced about axis 64, the drive gear 56 remains in meshing engagement with idler gear 58 and walks therearound in a planetary fashion.

The arm 62 is provided with an elongate arcuate groove 77 formed therein, which groove is also generated about axis 64 as a center, and has an arcuate extent substantially equal to or slightly greater than the arcuate extent of slot 76. A suitable threaded fastener or stud 78 is fixed to the inner sidewall 71 and projects through the groove 77. A suitable lock nut 79 is secured on the outer end of the threaded stud 78 so as to permit the arms 62–63 to be fixedly secured at any selected arcuate position as permitted by the arcuate slots 76. To permit the position of roller 46 and hence arms 62–63 to be varied, the outer housing sidewall 72 is selectively removed, as by removal of screws or the like, thereby providing access to the lock nut 79. By suitably loosening same, the arms 62–63 and roller 46 can be swingably displaced into a desired location, following which the lock nut 79 is then retightened, and the housing sidewall 72 resecured so as to protectively enclose the drive mechanism.

Figure 7:
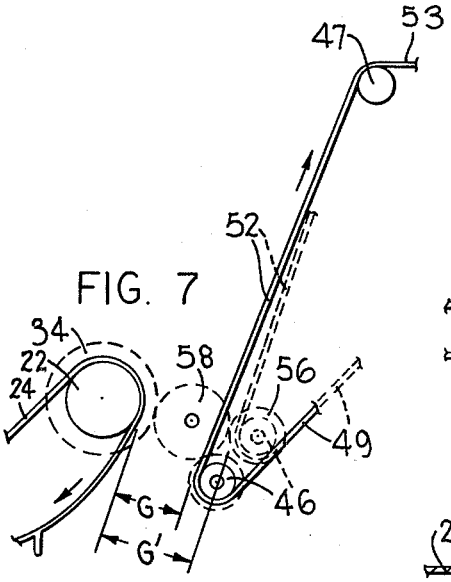
FIG. 7 diagrammatically illustrates the manner in which the separation gap can be adjusted according to the improved arrangement illustrated by FIGS. 5 and 6.

When utilizing the conveyor-separator apparatus incorporating the improved separator unit 12', the width of the separating gap can be adjusted over a substantial range, such as between the range G and G' as diagrammatically illustrated in FIG. 7. When the gap is smallest, the adjusting structure 61 is positioned so that the roller shaft 57 is adjacent the lower end of the arcuate guide slots 76, whereupon the gear 56 and roller 46 are disposed substantially as illustrated by solid lines in FIG. 7. When so positioned, the inclined reach 52 of the separating belt extends upwardly at a substantial angle relative to the vertical, such as at an angle which normally substantially equals or exceeds 60°, but is preferably slightly less than 90°, since this enables the fingers 51 on the belt section 52 to effectively engage the runners and carry them upwardly around the upper roller 47 onto the horizontal belt section 53, which turning around the roller 47 tends to loosen the engagement of the runners on the fingers, following which the turning around the front roller 48 causes the runners to be discharged into a suitable collecting device. At the same time, the parts which are deposited in the gap G fall downwardly therethrough, as by passing between the adjacent fingers 51, and hence are suitably collected below the gap.

If the parts and runners are too large so as to permit effective separation when utilizing the minimum gap G, then the gap can be increased up to a maximum distance equal to G'. This increase in the gap is easily accomplished merely by removing the housing sidewall 72, and loosening the lock nut 79, following which the arms 62–63 are manually swingably displaced along the groove 76 toward the upper end thereof. This causes the axis of shaft 57, which is also the axis of belt roller 46, to be moved further away from the rear wall of the housing, and hence this thus similarly causes the belt reach 52 to be moved away from the opposed conveyor belt, such as indicated by the dotted line position in FIG. 7, so that the width G' of the separation gap is hence increased. When the desired gap width is obtained, the lock nut 79 is again tightened in this new position, whereby the lower belt pulley 46 is thus stationarily secured in this position while at the same time the inclined belt reach 52 still remains at a substantial upwardly-directed angle which is not significantly changed so as to permit effective separation. Further, this has been accomplished without requiring any disconnection or replacement of the slave gear drive train, inasmuch as the driven gear 56 merely walks around the idler gear 58 during the positional adjusting operation. With this increased separation gap G', larger parts and runners can now be effectively supplied to the gap and efficiently separated, with the larger parts again falling downwardly through the gap, and the larger runners becoming effectively engaged by the fingers and carried upwardly by the fingered separator belt for discharge adjacent the frontmost belt roller 48.

To remove slack from the fingered belt 49 after the roller 46 has been adjusted, the shaft which mounts the front roller 48 has its ends supported in bearing blocks which are slidable along elongate grooves 81 (FIG. 1) formed in the separator housing. These bearing blocks can be fixed to the housing at an adjusted position to maintain belt 49 free of slack.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an apparatus for conveying and separating a mixture of plastic components, such as a mixture of molded plastic parts and runners, including:

a conveyor unit including a conveyor housing, a pair of horizontally spaced end rolls supported on the conveyor housing for rotation about substantially horizontal axes, an endless component-supporting conveyor belt extending between and supported on said end rolls, a drive motor, and drive transmission means drivingly connected between said motor and at least one said end roll for causing the upper reach of the belt to move from said first roll toward said second roll, said belt wrapping around said second end roll for permitting the components on the belt to be discharged into a gap disposed adjacent said second end roll, and said drive transmission means including a driving gear rotatably supported on said conveyor housing at the end thereof adjacent said second end roll;

a fingered separator unit for effecting separation of said runners from said parts, said separator unit being independent of said conveyor unit and including a separator housing which is separate from said conveyor housing, and means for fixedly and stationarily joining said separator housing to said conveyor housing adjacent said end thereof so that said separator unit cooperates with said second end roll for defining said gap therebetween;

said separator unit including a plurality of support rollers rotatably supported on said separator housing for rotation about spaced but substantially parallel horizontal axes, an endless separating belt supported on and extending between said plurality of support rollers, said separating belt having a plurality of fingers mounted thereon and projecting transversely outwardly therefrom, said fingers being positioned at selected intervals both transversely and longitudinally of said separating belt so that the parts are sized to move between said fingers whereas the runners are caught by the fingers and carried along with the separating belt, a first said support roller being vertically spaced a substantial distance above and horizontally spaced from a second said support roller so that said separating belt includes an inclined reach which extends upwardly from said second support roller toward said first support roller, said inclined reach being disposed in opposed and adjacent relationship to said second end roll but being horizontally spaced therefrom for defining said gap therebetween, an idler gear rotatably supported on said separator housing at the end thereof adjacent said inclined reach, said idler gear being disposed in close proximity to but radially spaced relationship from one of said support rollers, said idler gear being meshingly connected with and rotatably driven by said driving gear when said separator and conveyor housings are joined together, and drive means drivingly connected between said idler gear and said one support roller for rotatably driving the latter to effect driving of said separating belt, said drive means including a driven wheel coaxially nonrotatably secured to said one support roller and drivingly connected with said idler gear;

the improvement comprising adjustable mounting means rotatably supporting thereon said one support roller for permitting the axis of said one support roller to be horizontally displaced relative to said separator housing so as to selectively adjust the horizontal gap between said inclined reach and said second end roll, said mounting means being movably supported on said separator housing for swingable movement of said one support roller relative to said separator housing about the axis of said idler gear while maintaining the driving connection between said idler gear and said driven wheel.

2. An apparatus according to claim 1, wherein said adjustable mounting means includes a pair of parallel arms which are swingable about said axis and are disposed adjacent the opposite sides of said separator housing, said one support roller extending between and being rotatably supported on said arms so that its axis of rotation is spaced radially from the axis of said idler gear, and means for selectively locking the arms relative to said separator housing in their adjusted position.

3. An apparatus according to claim 2, wherein said driven wheel comprises a driven gear which is meshingly interconnected to and driven by said idler gear.

4. An apparatus according to claim 2 or claim 3, wherein said one support roller comprises said second roller.

5. An apparatus according to claim 1, wherein said separator unit includes a third said support roller which is horizontally spaced forwardly from both of said first and second support rollers so that said rollers maintain said endless belt in a triangular configuration.

6. An apparatus according to claim 5, wherein said one support roller comprises said second roller.

7. An apparatus according to claim 6, wherein said adjustable mounting means comprises a pair of parallel arms which are disposed adjacent the opposite sides of said separator housing and are swingable about said axis, said second roller extending between and being rotatably supported on said arms so that the rotational axis of said second roller is radially spaced from the axis of said idler gear, said driven wheel comprising a driven gear which is coaxial with and nonrotatably connected to said second roller, said driven gear being disposed in direct meshing engagement with said idler gear, and holding means for fixedly securing said arms relative to said separator housing in the selected adjusted position of said second roller.

8. An apparatus according to claim 1, wherein said separator and conveyor housings have opposed end walls which are disposed substantially in direct abutting engagement when said separator and conveyor units are fixedly mounted together, the end wall of said conveyor housing having an elongated opening therein and said driving gear being positioned in alignment with but spaced inwardly from said elongated opening for permitting access to said driving gear, the end wall of said separator housing also having an elongated opening formed therein and said idler gear being positioned adjacent said end wall so that said idler gear projects through said last-mentioned opening and through the opening in the conveyor housing for direct meshing engagement with the driving gear when the two housings are fixedly joined together, said separator unit being totally supported by its direct engagement with the conveyor housing.

9. An apparatus according to claim 1, wherein said driving gear is coaxially and nonrotatably connected to said second end roll, said idler gear being directly meshingly engaged with said driving gear, and said driven wheel being a gear which is directly meshingly engaged with said idler gear.

10. In a fingered separator for separating a mixture of plastic components, such as a mixture of plastic parts and runners, including a housing, three support rollers rotatably supported on said housing in spaced relationship so that said rollers are rotatable about parallel horizontally-extending axes, an endless fingered separating belt extending between and being supported by said three support rollers, said belt having a plurality of fingers fixedly mounted thereon and projecting transversely outwardly therefrom, said fingers being positioned at selected intervals both transversely and longitudinally of said belt so that parts are sized to move between said fingers whereas the runners are caught by the fingers and carried along with the belt, said three support rollers being disposed in a triangular configuration so that a first said roller is positioned vertically upwardly a substantial distance above and slightly horizontally spaced from a second said roller so that said belt includes an inclined reach which extends upwardly from said second roller toward said first roller, said inclined reach being sloped upwardly at a substantial angle relative to the horizontal, and a third said roller being horizontally spaced a substantial distance from both of said first and second rollers so that the inclined reach of the belt passes around the first roller with the belt then extending approximately horizontally toward the third roller so that the fingers in this latter-mentioned portion of the belt project approximately upwardly, drive means drivingly interconnected to one of said support rollers for rotatably driving same to effect driving displacement of said belt, said drive means including a first gear rotatably supported on said housing for rotation about an axis which is parallel with but horizontally spaced from the axes of said three support rollers, and a second gear which is coaxially fixedly connected to said one support roll and is drivingly engaged with and driven by said first gear, the improvement comprising adjusting means for movably displacing said one support roller relative to said housing in a transverse direction relative to the elongated direction of said inclined reach without disrupting the drive connection between said first and second gears, said adjusting means being movably supported on said housing for at least limited swinging movement about the axis of said first gear, and said one support roller being rotatably supported on said adjusting means at a location wherein the axis of said one support roller is spaced radially from the axis of said first gear.

11. An apparatus according to claim 10, wherein said adjusting means includes a pair of parallel arms which are disposed adjacent the opposite sides of said housing and are swingable about the axis of said first gear, said one support roller being rotatably supported on said arms at a location spaced radially from said last-mentioned axis, stop means coacting between said housing and said adjusting means for permitting swingable displacement of said adjusting means and of the support roller mounted thereon through only a limited angular extent, and holding means coacting between said housing and said adjusting means for fixedly securing said adjusting means relative to said housing in any selected position.

12. An apparatus according to claim 10 or claim 11, wherein said one support roller comprises said second roller, and wherein said second gear is disposed in direct meshing engagement with said first gear.

* * * * *